US008122620B2

(12) United States Patent
Männikkö et al.

(10) Patent No.: US 8,122,620 B2
(45) Date of Patent: Feb. 28, 2012

(54) SCREENING, CRUSHING OR MIXING BUCKET

(75) Inventors: Ari Männikkö, Nastola (FI); Joonas Eloranta, Heinola (FI); Anatoli Lappalainen, Lahti (FI)

(73) Assignee: Allu Finland OY, Orimattila (FI)

( * ) Notice: Subject to any disclaimer, the term of this patent is extended or adjusted under 35 U.S.C. 154(b) by 141 days.

(21) Appl. No.: 12/695,496

(22) Filed: Jan. 28, 2010

(65) Prior Publication Data

US 2010/0192424 A1 Aug. 5, 2010

(30) Foreign Application Priority Data

Feb. 4, 2009 (FI) ..... 20095100

(51) Int. Cl.
*E02F 3/40* (2006.01)

(52) U.S. Cl. ..... 37/444; 37/403; 241/157; 74/609

(58) Field of Classification Search ..... 37/250, 37/341, 379, 444, 445, 901, 903, 403; 241/101.77, 241/157, 236; 74/609
See application file for complete search history.

(56) References Cited

U.S. PATENT DOCUMENTS 3,233,686 A * 2/1966 Steadman ..... 172/119
3,901,325 A * 8/1975 Richards ..... 172/81
5,379,534 A * 1/1995 Negishi ..... 37/379
5,405,092 A * 4/1995 Jonninen ..... 241/27
5,592,760 A * 1/1997 Kohout ..... 37/403
5,619,811 A * 4/1997 Yrjola ..... 37/466
5,887,810 A * 3/1999 Maruyama ..... 241/189.1
6,193,403 B1 * 2/2001 Nystrom ..... 366/26
7,506,461 B2 * 3/2009 Jonninen ..... 37/403
7,712,233 B2 * 5/2010 Nesseth ..... 37/420
2010/0162592 A1 * 7/2010 Mannikko ..... 37/403

* cited by examiner

*Primary Examiner* — Robert Pezzuto
*Assistant Examiner* — Jamie L McGowan
(74) *Attorney, Agent, or Firm* — Sterne, Kessler, Goldstein & Fox P.L.LC.

(57) ABSTRACT

A screening, crushing or mixing bucket is formed into a bucket of an excavating machine or bucket loader. The bucket comprises a bottom plate, side walls, and at the back of the bucket working drums rotatable about their shafts, which screen, crush or mix the material in the bucket as they rotate and at the same time deliver screened, crushed or mixed material out of the bucket, between or through the working drums. In the bucket are casings for the power transmission and bearings of the working drums. The casings are limited by frame plates to which the bearing housings of the drums are attachable. On the frame plate and/or on the inner side of the inner wall is fixed a mudguard, which extends between the shafts of the working drums, next to the lead-throughs of the shafts, and the mudguard comprises cut-outs for receiving the shafts of the working drums.

2 Claims, 3 Drawing Sheets

SCREENING, CRUSHING OR MIXING BUCKET

BACKGROUND OF THE INVENTION

The invention relates to a screening, crushing or mixing bucket, which is formed into a bucket of an excavating machine or bucket loader, comprising a bottom plate, side walls and at the rear part of the bucket working drums rotatable about their shafts, which screen, crush or mix the material in the bucket as they rotate and at the same time deliver screened, crushed or mixed material out of the bucket between or through the working drums, and casings for the power transmission and bearings of the working drums, the said casings being limited by frame plates to which the bearing housings of the drums are attachable.

A bucket of this type is known from the Applicant's international patent application WO 0158595. In this and other known buckets, a problem is presented by wear in the slot which is formed between the rotating shaft and the frame. The material in the bucket continuously presses new wearing material into this slot, which will eventually result in damage to the bearings.

BRIEF SUMMARY OF THE INVENTION

The aim of the invention is to solve this problem by means of a structure which prevents direct material pressure on the said slot.

This aim is achieved by means of the bucket according to the invention, the characterising features of which are disclosed in the appended claim 1.

The solution is, therefore, based on the use of a separate mudguard made of wear-resistant steel. In a preferred embodiment of the invention, the mud-guard is used together with the end flanges of the working drums. The mud-guard prevents direct material pressure on the slot between the frame and the shaft and, in a preferred embodiment of the invention, forms a labyrin-thine structure together with the end flange. The section to be sealed is, therefore, only stressed by dust.

BRIEF DESCRIPTION OF THE FIGURES

One example of the invention is described in greater detail in the following, with reference to accompanying drawings, in which.

DETAILED DESCRIPTION OF THE INVENTION

Figure 1:
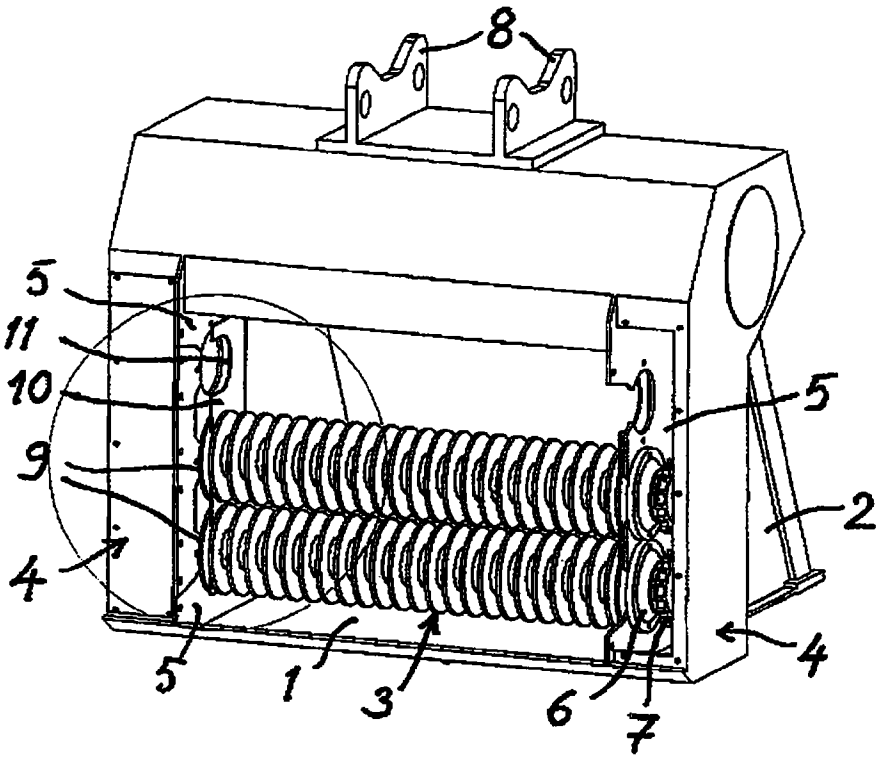
FIG. 1 shows a perspective view of the bucket according to the invention from behind, partly opened and with the topmost working drum detached.
Figure 2:
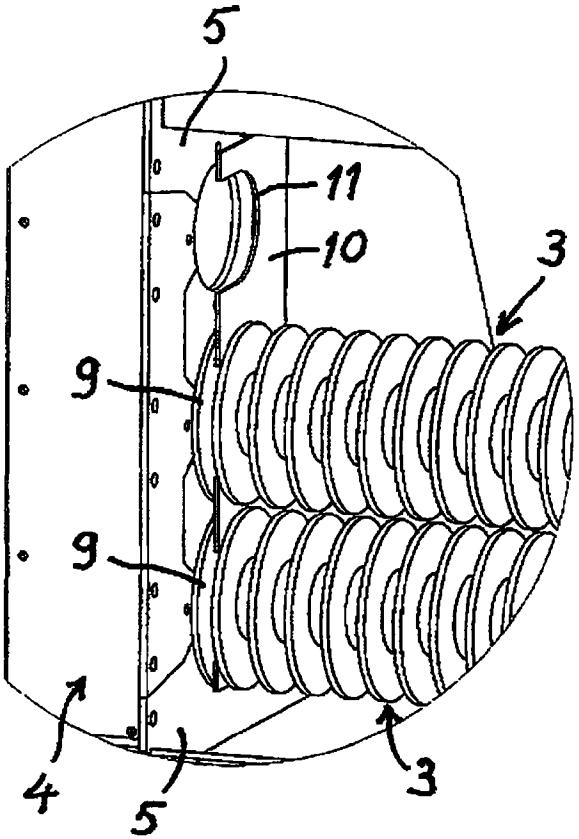
FIG. 2 shows a detail of FIG. 1 on a larger scale.
Figure 3:
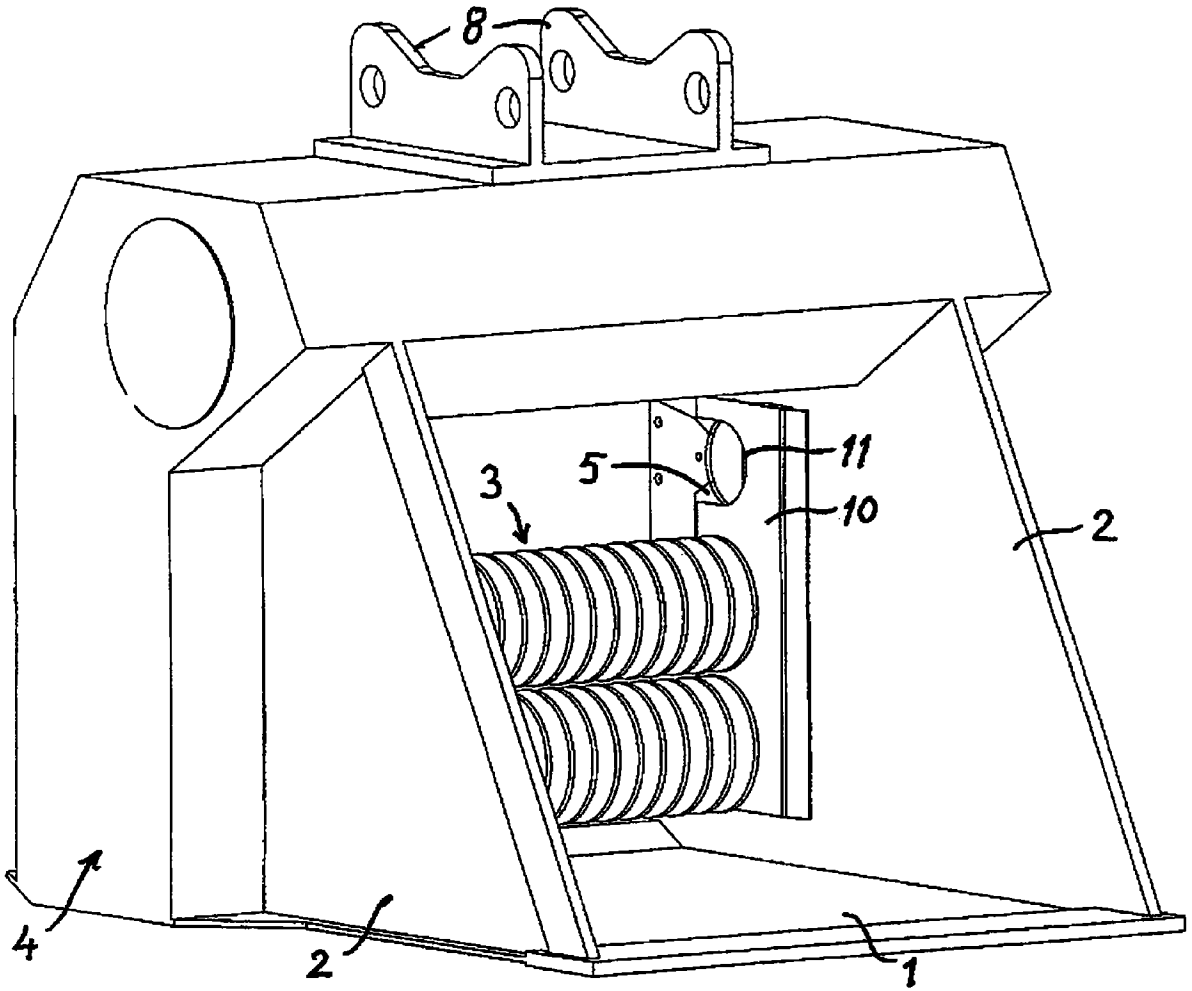
FIG. 3 shows the bucket of FIG. 1 as seen diagonally from the front.
Figure 4:
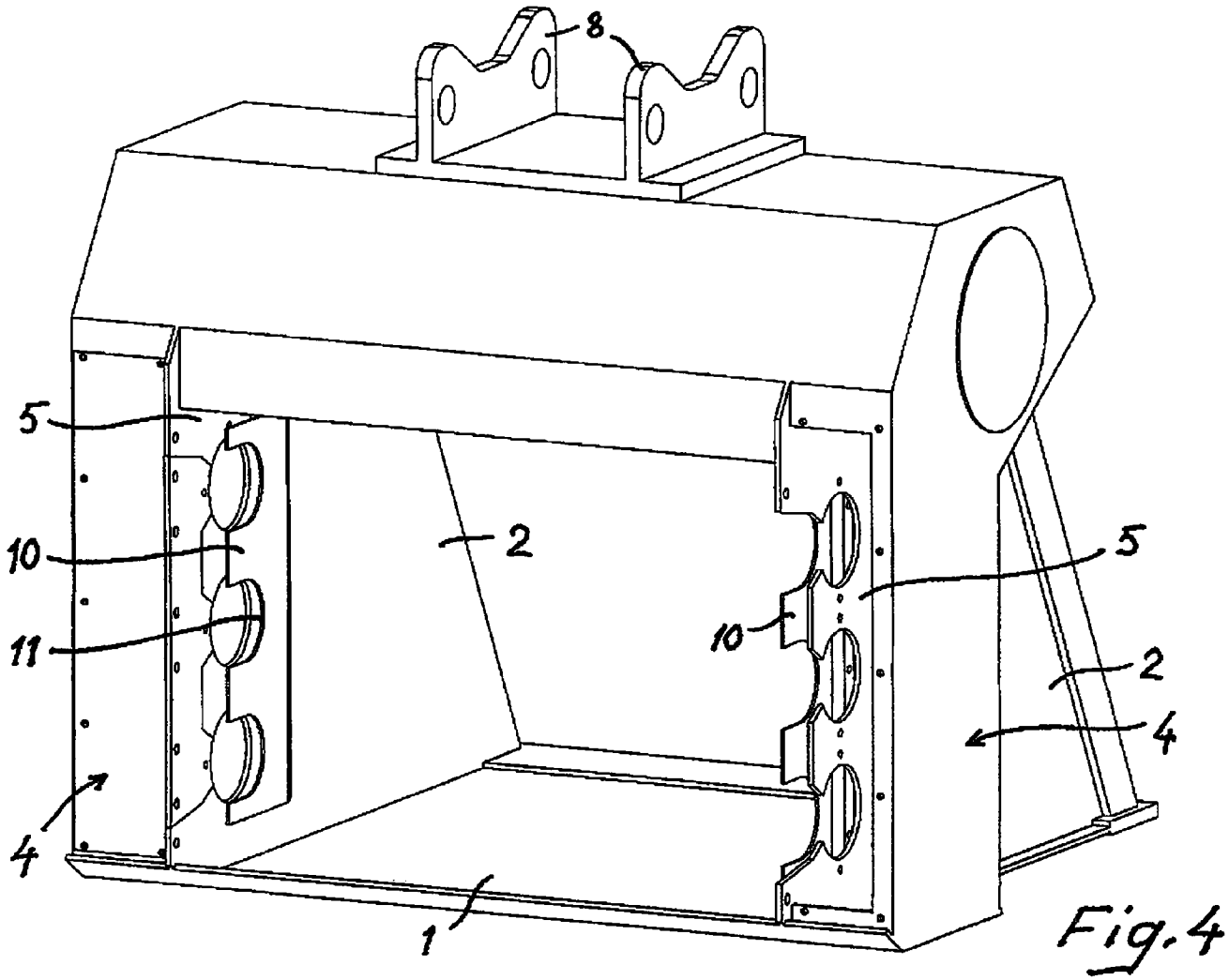
FIG. 4 shows the same as FIG. 1, but without the working drums.

The bucket according to the invention can be fixed to be the bucket of an excavating machine or bucket loader, for which purpose there are fastening lugs 8 on the top side of the bucket.

The bucket comprises a bottom plate 1, side walls 2 and at the rear part of the bucket working drums 3 rotatable about their shafts, which screen, crush or mix the material in the bucket as they rotate and at the same time deliver screened, crushed or mixed material out of the bucket between or through the working drums 3. Between the flanges of the working drums 3 may be fixed different types of crushing teeth, which are not shown.

To the rear parts of the side walls 2 are attached casings 4 for the power transmission and bearings of the working drums 3. In the embodiment shown, the casings 4 are separated from the interior of the bucket by frame plates 5, to which the bearing housings 6 of the working drums 3 are attachable. In the case shown, the frame plates 5 are a direct extension of the side walls 2 and of the same plate material as the side walls 2.

The working drums 3 have end flanges 9 which are located on the opposite side of the frame plate 5 with respect to the bearing housing 4, immediately adjacent to the frame plate 5. The end flanges 9 rotate with each working drum 3, that is, the end flanges 9 are attached to the shaft of the working drum 3.

On the inner side of the frame plate 5 and/or of the inner wall 2 is fixed a mudguard 10, which extends next to the end flanges 9 so that at least a part of each end flange 9 remains between the frame plate 5 and the mudguard 10. The mudguard 10 guides the material being processed past the slot between the end flange 9 and the frame plate 5.

In the disclosed example, the mudguard 10 is comprised of a protective plate 10 transverse to the axial direction of the working drums, the plate extending partly over the end flanges 9. The mudguard 10 has cut-outs 11 for receiving the shafts of the working drums 3. The cut-outs or slots 11 allow the mudguard 10 to be replaced without detaching the shaft of the working drum. At the same time, the structure has clearance towards the trailing side in the direction of flow of the material, and thus material passing between the mudguard 10 and the frame plate 5 is easily removed therefrom.

What is claimed is:

1. A screening, crushing or mixing bucket, which is formed into the bucket of an excavating machine or bucket loader, comprising:

a bottom plate;

side walls;

working drums at a rear part of the bucket rotatable about their shafts, which screen, crush or mix material in the bucket as they rotate and at the same time deliver screened, crushed or mixed material out of the bucket, between or through the working drums; and casings for a power transmission and bearings of the working drums, the casings being limited by frame plates to which bearing housings of the working drums are attachable, wherein:

a mudguard is fixed on an inner side of the frame plate or an inner side of the side wall, which extends between the shafts of the working drums, next to lead-throughs of the shafts, the mudguard comprises cut-outs for receiving the shafts of the working drums, the working drums comprise end flanges which are located on an opposite side of the frame plate with respect to the bearing housing, immediately adjacent to the frame plate, the mudguard extends next to the end flanges so that at least a part of each end flange remains between the frame plate and the mudguard to guide the material being processed past the slot between the end flange and the frame plate, and the end flanges rotate with each working drum attached to the shaft of the working drum.

2. The bucket as claimed in claim 1, wherein the mudguard comprises a plate transverse to an axial direction of the working drums, wherein the plate extends partly over the end flanges.

* * * * *